US011015267B2

(12) United States Patent
Beachley

(10) Patent No.: US 11,015,267 B2
(45) Date of Patent: May 25, 2021

(54) SYSTEM AND METHOD FOR ELECTROSPUN FIBER STRAINING AND COLLECTING

(71) Applicant: Rowan University, Glassboro, NJ (US)

(72) Inventor: Vince Beachley, Medford Lakes, NJ (US)

(73) Assignee: Rowan University, Glassboro, NJ (US)

( * ) Notice: Subject to any disclaimer, the term of this patent is extended or adjusted under 35 U.S.C. 154(b) by 24 days.

(21) Appl. No.: 15/568,725

(22) PCT Filed: Apr. 22, 2016

(86) PCT No.: PCT/US2016/028918

§ 371 (c)(1),
(2) Date: Oct. 23, 2017

(87) PCT Pub. No.: WO2016/172531

PCT Pub. Date: Oct. 27, 2016

(65) Prior Publication Data

US 2018/0291527 A1 Oct. 11, 2018

Related U.S. Application Data

(60) Provisional application No. 62/151,651, filed on Apr. 23, 2015.

(51) Int. Cl.
*D01D 5/00* (2006.01)
*D04H 1/728* (2012.01)

(52) U.S. Cl.
CPC ..... *D01D 5/0076* (2013.01); *D04H 1/728* (2013.01)

(58) Field of Classification Search
CPC ..... D01D 5/0076; D04H 1/728
USPC ..... 425/174.8 R
See application file for complete search history.

(56) References Cited

U.S. PATENT DOCUMENTS 5,487,526 A 1/1996 Hupp
6,017,476 A 1/2000 Renshaw
7,828,539 B1 * 11/2010 Beachley ..... D01D 5/0076 264/465

(Continued)

FOREIGN PATENT DOCUMENTS

EP 2045375 A1 * 4/2009 ..... D01D 5/0076
EP 2045375 A1 4/2009

(Continued)

OTHER PUBLICATIONS

Electrospun carbon nanofibers from polyacrylonitrile blended with activated or graphitized carbonaceous materials for improving anodic bioelectrocatalysis (Year: 2013).*

(Continued)

*Primary Examiner* — Francisco W Tschen
*Assistant Examiner* — Guy F Mongelli
(74) *Attorney, Agent, or Firm* — Saul Ewing Arnstein & Lehr LLP; Domingos J. Silva; Paul A. Leicht

(57) ABSTRACT

The invention provides a system and process for manufacturing nanofibers that integrate a post-drawing process in a continuous electro spinning manufacturing process. In certain embodiments, the system and process are capable of post-drawing multiple individual electrospun nanofibers simultaneously. In certain embodiments, the system can be configured and controlled to accommodate various materials that can be electrospun.

13 Claims, 13 Drawing Sheets

(56) References Cited

U.S. PATENT DOCUMENTS 8,124,001 B1 * 2/2012 Wen ..... D01D 5/0076 428/373
8,580,181 B1 11/2013 Beachley et al.
8,980,158 B2 * 3/2015 Lennhoff ..... D01D 5/0076 264/465
10,415,156 B2 * 9/2019 Khandaker ..... D01D 5/0084
10,633,766 B2 * 4/2020 Haff ..... D01D 5/0084
10,640,888 B1 * 5/2020 Haff ..... B05B 5/14
2005/0224999 A1 * 10/2005 Andrady ..... D01D 5/0061 264/10
2006/0213829 A1 * 9/2006 Rutledge ..... D01D 5/0007 210/503
2007/0261959 A1 * 11/2007 Kim ..... B82Y 15/00 204/424
2008/0122142 A1 * 5/2008 Kim ..... D01D 5/0061 264/484
2008/0176129 A1 * 7/2008 Lee ..... H01M 4/9083 429/516
2010/0093093 A1 * 4/2010 Leong ..... A61L 27/3847 435/396
2010/0248301 A1 9/2010 Ulbrich et al.
2010/0327494 A1 * 12/2010 Jabbari ..... D01D 5/0076 264/466
2011/0006218 A1 * 1/2011 Mochalin ..... C01B 32/28 250/459.1
2011/0111012 A1 * 5/2011 Pepper ..... A61F 13/00995 424/445
2011/0212321 A1 * 9/2011 Cakmak ..... D01D 5/0084 428/323
2011/0264235 A1 * 10/2011 Chen ..... B01D 69/08 623/23.72
2012/0040461 A1 * 2/2012 Beachley ..... A61L 27/48 435/396
2012/0040581 A1 * 2/2012 Kim ..... D06M 11/00 442/330
2012/0046434 A1 * 2/2012 Lee ..... H01M 4/926 526/341
2012/0077032 A1 * 3/2012 Chasiotis ..... D01F 9/14 428/373
2012/0112389 A1 * 5/2012 Wu ..... D01D 5/003 264/466
2013/0075326 A1 * 3/2013 Yun ..... B29C 37/0067 210/505
2013/0118973 A1 * 5/2013 Seo ..... B01D 29/0093 210/435
2013/0233780 A1 * 9/2013 Olesik ..... G01N 30/93 210/198.3
2013/0273190 A1 * 10/2013 Lee ..... D01D 5/0061 425/174.8 E
2014/0051316 A1 * 2/2014 Zhang ..... D04H 1/74 442/401
2014/0079759 A1 * 3/2014 Patel ..... A61L 27/50 424/443
2014/0273079 A1 9/2014 McCormick
2014/0291897 A1 * 10/2014 Westbroek ..... D01D 5/0061 264/465
2015/0136693 A1 * 5/2015 Hwang ..... B32B 38/0032 210/502.1
2015/0160104 A1 6/2015 Berberich
2015/0352767 A1 * 12/2015 Kalra ..... D01D 10/02 428/367
2015/0360158 A1 * 12/2015 Menkhaus ..... B01D 15/3809 264/10
2016/0047063 A1 * 2/2016 Khandaker ..... D01D 5/0084 425/174.8 E

FOREIGN PATENT DOCUMENTS

WO WO-2013123137 A1 * 8/2013 ..... C04B 35/6325
WO WO-2013130712 A1 * 9/2013 ..... H01M 4/13

OTHER PUBLICATIONS

Synthesis of electrospun polyacrylonitrile-derived carbon fibers and comparison of properties with bulk form (Year: 2018).*
Zussman et al., "Mechanical and structural characterization of electrospun PAN-derived carbon nanofibers," Carbon (2005); 43(10)2175-2185.
Bahaman et al, "A review of heat tgreatment on polyacrylonitrile fibert," Polymer Degradation and Stability (2007); 92(8):1421-1432.
Ozbek et al., "Strain-induced density changes in PAN-based carbon fibres," Carbon (2000); 38(14):2007-2016.
Persano et al., "Industrial Upscaling of Electrospinning and Applications of Ppolymer nanofibers: A Review," Macromol. Mater. Eng. (2013); 298:504-520.
Yao et al., "High Strength and High Modulus Electrospun Nanofibers," Fibers (2014); 2(2):158-186.

* cited by examiner

| | Polymer/material | Molecular Unit | High Order Structure | Solvents | Boiling point °C | Functional testing |
|---|---|---|---|---|---|---|
| Synthetic | PAN | | | DMF<br>DMSO | 153.0<br>189.0 | Mechanical<br>Carbonization |
| | PVDF | | | DMF<br>DMAC<br>Acetone | 153.0<br>165.1<br>56.3 | Mechanical<br>Piezo-induction |
| | *Polyaniline | | | Acetic Acid<br>HFIP<br>Chloroform<br>DMF | 118.0<br>58.2<br>61.2<br>153.0 | Mechanical<br>Electrical conductivity |
| Protein | Silk | | | Formic Acid<br>HFIP | 118.0<br>58.2 | Mechanical<br>Thermal conductivity |
| Inorganic | **Carbon | | | N/A | | Mechanical<br>Electrical conductivity<br>Thermal conductivity |

*Polyaniline is electrospun as a blended fiber with PEO, PMMA, or gelatin
** Carbon nanofibers are formed by thermal treatment of electrospun PAN nanofibers

FIG. 12

SYSTEM AND METHOD FOR ELECTROSPUN FIBER STRAINING AND COLLECTING

CROSS-REFERENCE TO RELATED APPLICATIONS

This application is a 35 U.S.C. § 371 national phase application of, and claims priority to, International Application No. PCT/US2016/028918, filed Apr. 22, 2016, which claims priority to U.S. Provisional Patent Application No. 62/151,651, filed Apr. 23, 2015, all of which applications are incorporated herein by reference in their entireties.

FIELD OF THE INVENTION

The present invention is related to system and method of manufacturing nanomaterials and particularly to system and method using electrospinning with integrated post-drawing.

BACKGROUND OF THE INVENTION

Nanofibers are valuable in a wide range of technological applications including high-strength light-weight composites, filtration/absorption materials, sensors/electronic devices and smart materials, batteries/energy harvest, and biomedical devices. However, the accessibility of nanofiber materials is limited because it is impossible to produce polymer nanofibers using conventional techniques. Conventional polymer fibers are manufactured by mechanical extrusion and a secondary post-drawing step that stretches the fiber to several times its original length to induce molecular alignment and impart strength. Nanofibers cannot be mechanically extruded, but an electrostatic extrusion methods known as electrospinning can be used to fabricate nanofibers from a wide variety of polymers. Unfortunately, the electrospinning method is limited by an overall lack of control over fiber manipulation and assembly. For example, post-drawing is not compatible with current nanofabrication systems, making it difficult to engineer high performance electrospun nanofibers. As a result, electrospun nanofibers are mechanically weaker than their conventional microfiber counterparts, contrary to the theoretical expectation of increased strength with decreasing diameter. Further, the highly charged and violently whipping jet used in electrospinning makes it difficult to collect ordered nanofibers within a continuous manufacturing process.

The present invention describes devices and methods that address some or all of the issues described above.

SUMMARY OF THE INVENTION

In one embodiment, a system for forming an electrospun nanofiber array may include two conductive collection surfaces, each having a proximate end and a distal end. The two conductive collection surfaces can be located facing each other and at a distance from each other. In one embodiment, the two conductive collection surfaces may be aligned to each other, such that the proximate ends of the two surfaces are aligned or correspond to each other, and the distal ends of the two surfaces are aligned or correspond to each other. In one embodiment, each of the two conductive collection surfaces may be an endless traveling belt. Additionally, the endless travelling belts may be laminated belts. The space in between the two conductive collection surfaces may include a deposition area and a collection compartment, with the deposition area being proximate to the proximate ends of the two conductive collection surfaces and the collection compartment following the deposition area. The system may also include a collection rack inside the collection compartment for removing a fiber from the conductive collection surface.

In one embodiment, at least a portion of the first conductive collection surface and a portion of the second conductive collection surface are facing each other at an angle. The angle may be between 0 and 90 degrees or between 0 and −90 degrees. These angled portions of the two conductive collection surfaces may also be aligned to each other and form two lateral sides of a isosceles trapezoid. The two conductive collection surfaces can be configured to move in the same direction away from the deposition area and receive in the deposition area fibers electrospun from an electrospinning nozzle proximate to the deposition. When a fiber is deposited to the deposition area, one end of the fiber will be adhered to the first conductive collection surface and the other end of the fiber is adhered to the second conductive collection surface. The successively formed fibers may be aligned, spaced apart from one another within the collection department and each of the fibers is elongated while moving along the angled portion of each of the two conductive collection surfaces.

Alternatively and/or additionally, each of the conductive collection surfaces may have a second portion, and the second portion of the first conductive collection surface may be disposed parallel to the second portion of the second conductive collection surface. In one embodiment, the order of the angled portion and the second portion of each of the conductive collective surface may be arranged in different ways. In one embodiment, the angled portion of the first conductive collection surface and the angled portion of the second conductive collection may define an area in between that includes the deposition area. In another embodiment, the second portion of the first conductive collection surface and the second portion of the second conductive collection define an area in between that includes the deposition area.

The two conductive collection surfaces may move at various speeds and have different dimensions and each part may have different geometric measurements depending on the materials to be used for electrospinning. For example, the speed may be between 0.5 and 100 cm/min. In one embodiment, the distance between the first conductive collection surface and the second conductive collection surface at the proximate end can be greater than about 2 micrometers. The distance between the first conductive collection surface and the second conductive collection surface at the distal end can be in the range of 5 to 50 centimeters.

The elongation ratio may depend on the angle of the angled portions of the first and second conductive collection surfaces. In one embodiment, the distance between the first conductive collection surface and the second conductive collection surface at the distal end can be about 100%-20,000% of that between the first conductive collection surface and the second conductive collection surface at the proximate end. In another embodiment, the ratio can be 100%-2,000%.

In one embodiment, a dual-track system may include two sets of collection systems as described above, each set may have two conductive collection surfaces. The two collection systems may be disposed proximate to each other and configured to move in the same direction away from the deposition area and receive in the deposition area fibers electrospun from an electrospinning nozzle proximate to the deposition area. A fiber that is electrospun and deposited in the deposition area can be adhered to the two conductive collection surfaces of the first collection system and transferred to the collection compartment of the second collection system. Similar to the single collection system, the successively formed fibers in the dual-track system can be aligned and spaced apart.

Each conductive collection surface of the dual-track system can be configured in various ways to accommodate different fabrication methods. For example, both collection systems may include parallel conductive collection surfaces. In another example, one system may have parallel surfaces, whereas the other may have angled conductive collection surfaces. The order of the two collection systems may vary as well.

In some embodiments, various methods of fabricating nanofibers may be provided by using the various systems in the present invention. In one embodiment, a method of forming an array of nanofibers may include the steps of: electrospinning a first fiber from an electrospinning nozzle, depositing the first fiber at a deposition area proximate to the electrospinning nozzle, moving the first conductive collection surface and the second conductive collection surface away from the deposition area such that the fiber is moved away from the deposition area and into the collection compartment, electrospinning a second fiber from the electrospinning nozzle, and depositing the second fiber at the deposition area subsequent to the motion of the first fiber away from the deposition area. The first and second fibers are aligned with one another and spaced apart from one another and elongated within the collection compartment.

Various materials can be used to fabricate nanofibers in the disclosed systems. For example, the method of fabrication may include electrospinning a precursor polymer including polyacrylonitrile (PAN), or lignin, which can become a carbon nanofiber while moving in the collection compartment. The fabrication method may also include electrospinning solvents encompassed by Hexafluoro-2-propanol or Dimethyl sulfoxide. The fabrication method may also include adjusting the geometry of the first portion of the first conductive collection surface via a first roller and the geometry of the first portion of the second conductive collection surface via a second roller.

BRIEF DESCRIPTION OF THE DRAWINGS

FIG. 12 illustrates various properties and fabrication conditions according to various embodiments.

DETAILED DESCRIPTION OF THE INVENTION

This disclosure is not limited to particular systems, methodologies or protocols described, as these may vary. The terminology used in this description is for the purpose of describing the particular versions or embodiments only, and is not intended to limit the scope.

As used in this document, any word in singular form, along with the singular forms "a," "an" and "the," include the plural reference unless the context clearly dictates otherwise. Unless defined otherwise, all technical and scientific terms used herein have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used herein, the term "comprising" means "including, but not limited to."

Nanotechnology offers vast potential in a wide variety of fields as broad as aerospace, transportation, energy, infrastructure, electronics, and biomedicine. Polymer nanofibers cannot be manufactured with conventional methods so other methods such as electrospinning must be utilized. Electrospinning is a highly promising process that has been explored and has been used to produce different types of natural and synthetic polymer nanofibers. However, integration of these materials into useful applications is another challenge. Some of these challenges are directly related to the difficulty of handling and processing extremely small, fragile nanofibers. Others stem from the high velocity, highly charged, random interactions that are specifically associated with the electrospinning process.

Unlike conventional polymer fiber manufacture, electrospun nanofibers cannot be fabricated and mechanically processed as a continuous filament. In fact, electrospun nanofibers are generally formed as a collective mesh where individual fibers cannot be separated out, as reviewed by Persano, L. et al, *Industrial Upscaling of Electrospinning and Applications of Polymer Nanofibers: A Review*. Macromolecular Materials and Engineering, 2013. 298(5): p. 504-520. These limitations make traditional fiber processing and assembly technologies non-applicable to electrospinning. For example, the essential post-drawing process used to enhance molecular alignment and mechanical strength in conventional fibers is not currently feasible for electrospun nanofibers. Further, post-drawing of individual electrospun nanofibers at production scale is not feasible either. Scalable production of electrospinning is also limited due to a lack of control over fiber arrangement. Even polymer nanofibers with inferior mechanical properties are only produced as randomly aligned films and meshes on an industrial scale.

Figure 1:
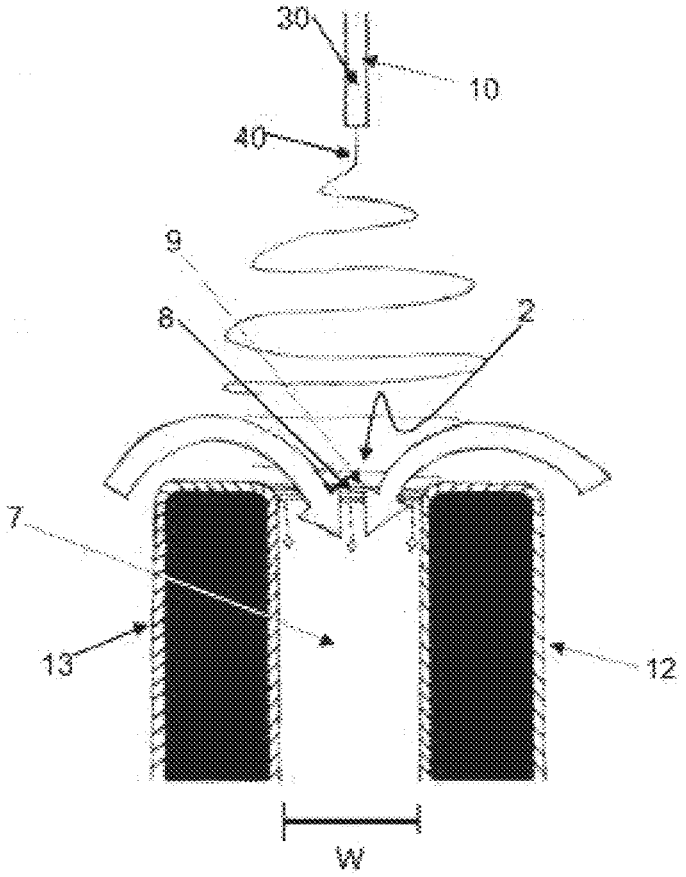
(PRIOR ART) FIG. 1
FIG. 1 illustrates an electrospinning system using two parallel tracks in the prior art.

FIG. 1 shows a system for collecting aligned electrospun nanofibers that was disclosed in the U.S. Pat. Nos. 8,580,181 and 7,828,539 to Beachley et al., both of which are incorporated herein by reference in their entirety. The nanofiber collecting device of Beachley includes two automated parallel tracks 12, 13 separated by an air gap. An electrospinning nozzle 10 can be loaded with any polymeric composition 30 suitable for use in an electrospinning process. Upon applying a suitable voltage to the needle, the repulsive electrostatic forces induced at the liquid/air interface will overcome the surface tension forces and a jet 40 of liquid will be ejected. The jet 40 travels toward the deposition area 2 and collection compartment 7. In the collection compartment, nanofibers are traveling with each end adhering to the surface of each of the parallel tracks and suspended between them. As fibers are moved away from the collecting location by the automated tracks more fibers are subsequently collected. The automated track manufacture methods will allow scaled production of ordered aligned nanofibers.

Figure 2:
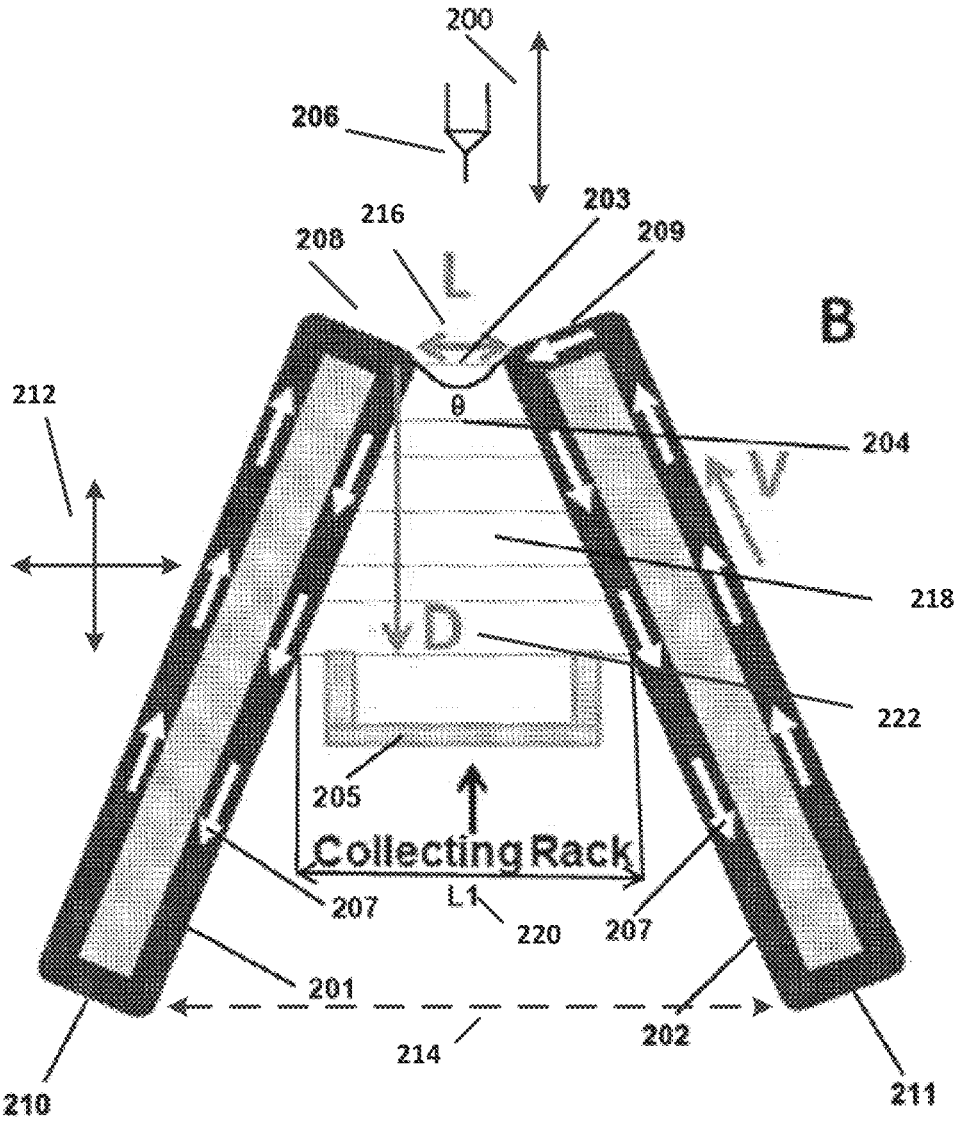
FIG. 2 illustrates an electrospinning system using two angled tracks for nanofiber collecting and post-drawing according to one embodiment.

With reference to FIG. 2, in one embodiment, an improved system over the automated tracks of Beachley (FIG. 1) integrates a post-drawing processing step directly into the manufacturing platform, thus making it possible for producing advanced nanofiber materials within a continuous manufacturing system. This manufacturing system also enables continuous production of ordered nanofiber arrays. For example, semi-solid electrospun nanofibers can be drawn immediately upon deposition before solvent has completely evaporated. This is called "wet-stretching." In one embodiment, a method in making nanofibers using the embodiment in FIG. 2 will allow enhanced engineered nanofibers to be translated into essential scalable processes such as staple yarn spinning.

The embodiment in FIG. 2 is further explained in detail herein below. The system may include a track system that includes two automated tracks that have conductive collection surfaces 201 and 202. The tracks or conductive collection surfaces 201 and 202 may be at a distance from and facing each other. The two conductive collection surfaces define a space in between that includes a deposition area 203 and a collection compartment 218. The two conductive collection surfaces 201 and 202 each has two ends: a proximate end 208, 209 and a distal end 210, 211 that is opposite to the proximate end. In one embodiment, the conductive collection surfaces 201 and 202 are aligned to each other, in particular, the proximate end 208 of surface 201 corresponds to the proximate end 209 of surface 202 and the distal end 201 of surface 201 corresponds to the distal end 211 of surface 202.

In one embodiment, the deposition area 203 may be proximate to the proximate end 208, 209 of each of the conductive collection surfaces, specifically, the deposition area can be defined as a gap between the two conductive collection surfaces 201, 202, which are separated by the gap at their proximate ends. The collection compartment 218 follows the deposition area. In one embodiment, the two conductive collection surfaces 201 and 202 are facing each other at a track angle θ, which is formed where both conductive collection surfaces 201 and 202 extend at their proximate ends 208 and 209 and intersect.

In one embodiment, the angle θ can range from 0 to 90 degrees. In this case, if the distance between the proximate ends 208, 209 remains unchanged, the larger the track angle θ is, the farther apart the distal ends of the two conductive collection surfaces are from each other. Similarly, the smaller the track angle θ is, the closer the distal ends of the two conductive collection surfaces are from each other. In one embodiment, the angle θ is 90 degrees, i.e. the conductive collection surfaces 201 and 202 are orthogonal to each other. In another embodiment, the angle θ can be less than 90 degrees. In another embodiment, the angle θ can be zero, in which case the two conductive collection surfaces 201 and 202 are parallel to each other.

Alternatively and/or additionally, the conductive collection surfaces 201 and 202 are aligned such that they form two lateral sides of an isosceles trapezoid. In one embodiment, an electrospinning nozzle 206 can be placed proximate to the proximate ends 208 and 209 of each of the two conductive collection surfaces, or a shorter base of the isosceles trapezoid. Alternatively and/or additionally, the system may also include a collection rack 205 that is placed inside the collection compartment, and typically positioned near the distal end 210, 211 of the conductive collection surfaces 201, 202.

In one embodiment, the two conductive collection surfaces 201 and 202 may be capable of motion in the direction marked by the arrows 207. As a nanofiber 204 is deposited into the deposition area 203 from the electrospinning nozzle 206, each end of the nanofiber is adhered to the conductive surfaces 201 and 202, thus the nanofiber 204 travels down with the movement of the tracks in the direction of the arrows 207. This allows the fiber that is deposited in the deposition area 203 to be moved away from the deposition area and into the collection compartment 218 and at the same time elongated/stretched while in the collection compartment. Elongation refers to the stretching or post-drawing of a fiber that is moving with the conductive collection surfaces 201, 202 and the stretching occurs in a direction that is perpendicular to the movement of the fiber in the collection compartment. Due to the motion of the angled collection surfaces 201 and 202, successively formed fibers are aligned, spaced apart from one another and elongated within the collection compartment, and finally collected. In one embodiment, the formed fibers can be removed from the collection compartment 218 into the collection rack 205.

Alternatively, in one embodiment, the angle formed by the proximate ends of the two conductive collection surfaces can be 0 to −90 degrees, which means that the two conductive collection surfaces are disposed in the same manner as positive angles but flipped upside down, i.e. the distal ends of the two conductive collection surfaces form the deposition area to receive a fiber electrospun from the electrospinning nozzle. As the two conductive collection surfaces move in the direction away from the electrospinning nozzle, the distance of the two surfaces becomes narrower and narrower. In this case, once a fiber is received in the deposition area, it is adhered to both conductive collection surfaces and becoming shortened due to the motion of the conductive collection surfaces. This may be useful for removing residual tension from the manufacturing process, or may have the effect of relaxing the fibers as they are collected.

Figure 3:
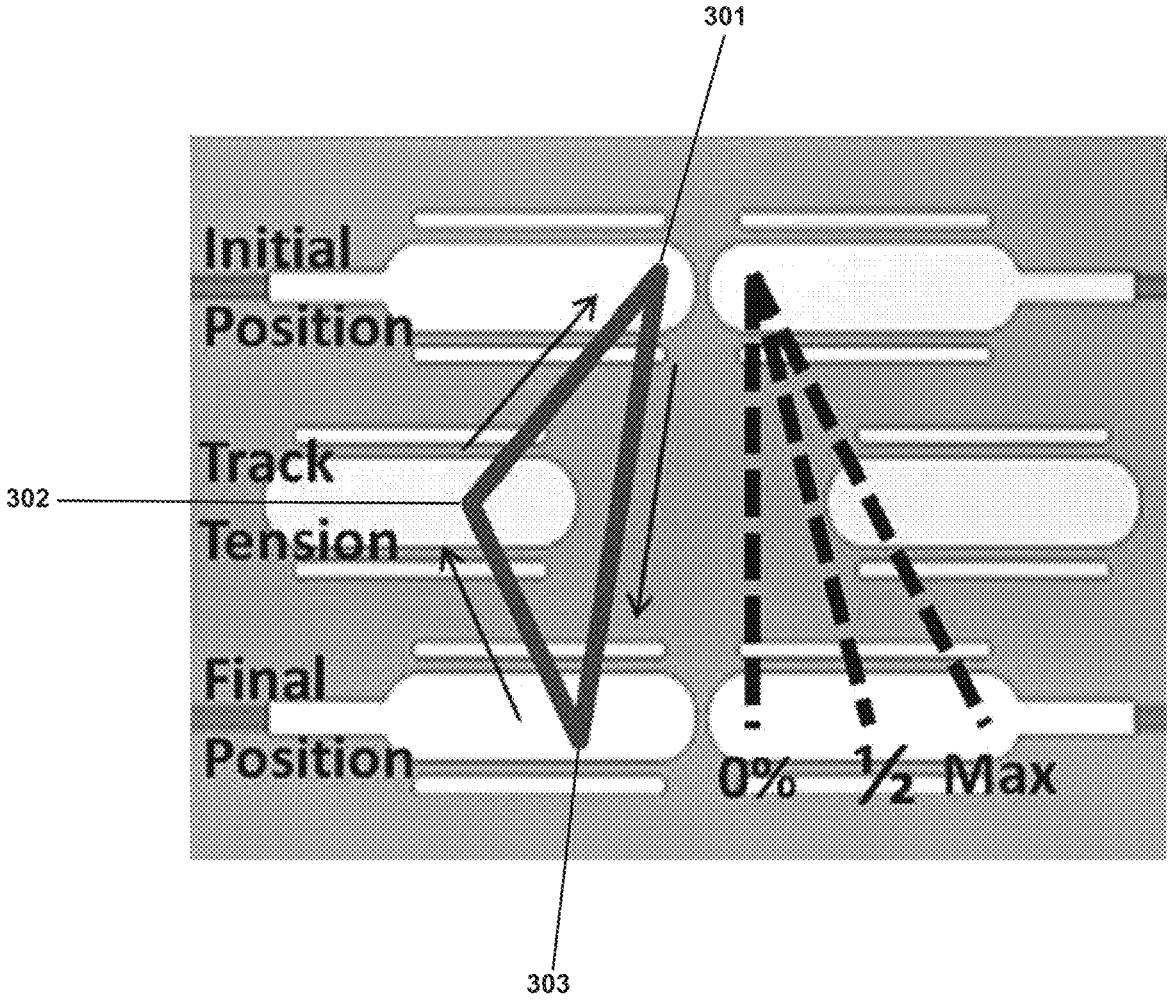
FIG. 3 illustrates a schematic of the end piece of the track allowing adjustment of the track according to one embodiment.

With further reference to FIG. 3, in one embodiment, the initial fiber length (or the gap between two conductive collection surfaces at the deposition area), the angle of the track θ, the total fiber elongation (or draw ratio, i.e. percentage of expansion of the fiber in length) and the draw rate (the rate of elongation per second) can be independently controlled. For example, each track may include a belt and three rollers that are available to turn the belt of the track. In one embodiment, each of the rollers may be mounted to a support member and may slide horizontally, thus enables adjustment of initial position, final position and track tension. For example, the top roller 301 may be moved to adjust the initial nanofiber length L (in FIG. 2) when a fiber enters the deposition area. Similarly, the bottom roller 303 may be moved to adjust the final position, which affects the angle of the track θ as well as the draw ratio or total elongation. The middle roller 302 may be moved to adjust the tension of the belt. One or more rollers may be driven by a motor to drive the belt of the track, or a separate roller is used to drive the belt. In one embodiment, the three rollers 301, 302 and 303 may be installed on each lateral side of the track, and the rollers may contain bearings and may be clamped to a fixed frame or support member.

Returning to FIG. 2, the electrospinning nozzle defines an axis 200 along the nozzle, and the collection compartment 205 may define a plane (e.g., denoted by axis 212) that is parallel to the axis 200 of the electrospinning nozzle 206. In another embodiment, the plane defined by the collection compartment may be normal to the axis 200 of the electrospinning nozzle 206. In one embodiment, the conductive collection surfaces 201 and 202 may be endless travelling belts. Additionally, the traveling belts may be laminated. Further, the speed of the belts or the motion of the conductive collection surfaces can be independently controlled. In one embodiment, the speed of the belt may be in the range between 0.1 cm/min and 1000 cm/min. In another embodiment, the speed of the belt may be between 0.5 and 100 cm/min.

In some embodiments, the initial length, i.e. the gap between the two tracks proximate to the electrospinning nozzle e.g., proximate gap 216), may be greater than 2 micrometers. The distance between the two tracks distal from the electrospinning nozzle may be in the range of 5-50 centimeters. The draw ratio measures the extent of elongation, and may be determined by the ratio of longest distance between the two tracks 201 and 202 in the collection compartment (i.e., L1 220) and the initial length L. As can be controlled by various parameters such as the initial length, the angle 204 of the tracks θ and the depth of the collection compartment 218 (i.e., D 222), the system can accommodate a wide range of draw ratio. In one embodiment, the draw ratio can be 1-2000% (i.e. 20×). In another embodiment, the draw ratio can be 4000%, 8000%, 10,000% or 20,000%. The draw rate could be in a wide range, such as 0-1000% elongation per second.

Alternatively and/or additionally, the embodiment in FIG. 2 may be temperature controller, allowing the fabrication of different materials at optimal condition. For example, for fabricating carbon fiber, the process may use temperatures up to 3000° C. and it may be of interest for some applications to stretch at reduced temperatures <0° C.

Figure 4:
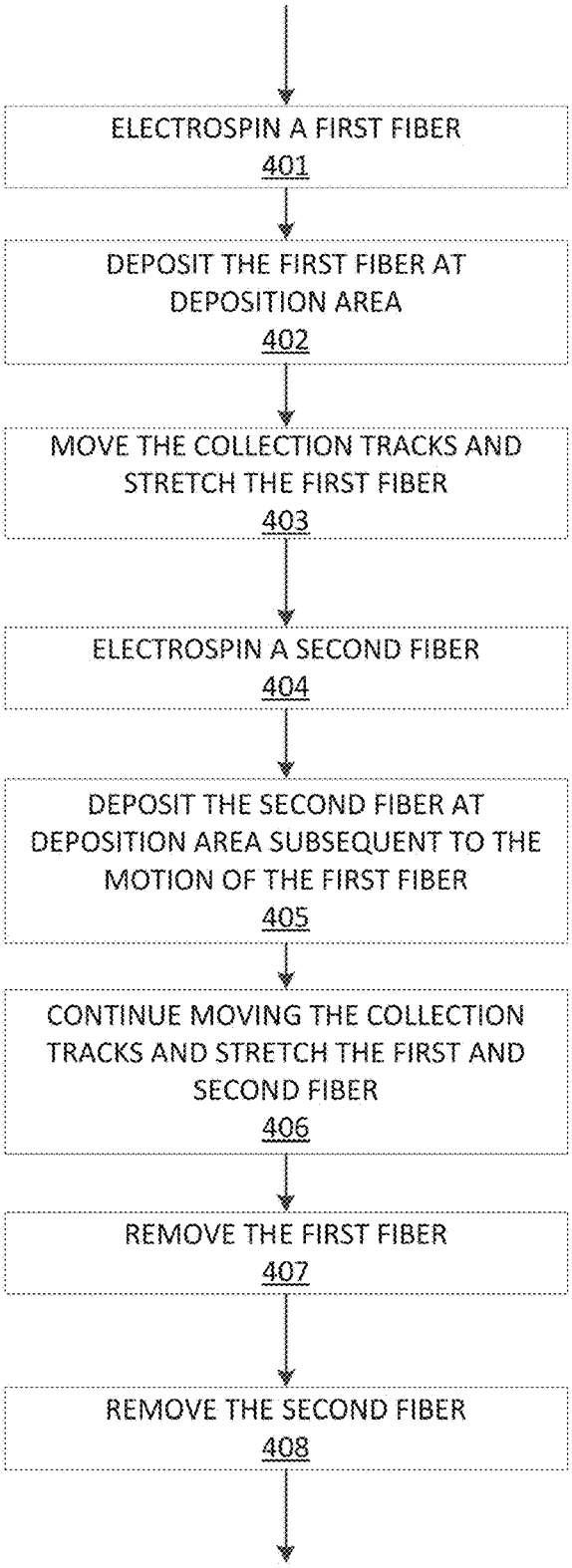
FIG. 4 illustrates the steps of manufacturing nanofibers according to one embodiment.

With reference to FIG. 4, a method for forming an array of fibers using the embodiment in FIG. 2 is described. The method may include electrospinning a first fiber from an electrospinning nozzle 401 and depositing the first fiber at a deposition area 402, where the first fiber is of finite length having two ends, each of the ends adhering to the conductive collection surface of each of the tracks. The method may also include moving both tracks 403 such that the first fiber is moved in a direction away from the deposition area and into the collection compartment. The method may also include electrospinning a second fiber 404 from the electrospinning nozzle and depositing the second fiber at the deposition area 405 subsequent to the motion of the first fiber away from the deposition area and into the collection compartment, continue moving the tracks 406 so that the second fiber is also moved in a direction away from the deposition area and into the collection compartment, the first and second fibers being aligned with one another and spaced apart from one another within the collection compartment. The method may also include removing the first fiber 407 and removing the second fiber 408 in the collection rack. In one embodiment, removing the fiber may include cutting the fiber from the collection rack. In one embodiment, the two tracks may be moving at the same speed, thereby the first and second fibers are substantially perpendicular to the axis of the electrospinning nozzle.

The method described herewith, with reference to FIG. 4, can be applied to various processes for manufacturing nanofibers and various parameters may be controlled depending on the materials. This includes adjusting the geometry of the tracks by moving the rollers, as disclosed in FIG. 3, adjusting the initial length, the speed of the tracks, the maximum distance between the tracks over the initial length, i.e. the draw ratio, and/or the temperature.

In one embodiment, the angled tracks disclosed in FIG. 2 allow individual fibers to be stretched immediately during collection, before the solvent evaporates while the polymer is moldable. In one embodiment, a process using the system and method disclosed above may include generating polymer nanofibers from a liquid solution through high-voltage electrospinning. For example, the fiber collection was conducted for an 18% polycaprolactone (PCL) polymer solution dissolved in 3:1 dichloromethane-dimethylformamide (DCM-DMF) solution. Samples were collected at four elongation ratios listed in Table 1. Collected samples were subjected to Fourier transform infrared spectroscopy (FTIR), scanning electron microscope (SEM) imaging, and tensile analysis to determine the properties of the fibers when subjected to drawing at different ratios during fiber manufacture. Sample fiber densities and diameters were determined using ImageJ software developed by National Institute of Health and individual fiber tensile strength calculated.

TABLE 1

| Sample | Ultimate Strength (Mpa) | Strain at UTS | Young's Modulus | Max Force (N) |
|---|---|---|---|---|
| 0% A | 905.2079926 | 1.146456693 | 789.5701583 | 3.9 |
| 0% B | 693.8219242 | 1.275240595 | 544.0713909 | 1.7 |
| 100% A | 273.2518476 | 0.729308836 | 374.672339 | 0.8 |
| 100% B | 443.6356865 | 0.692913386 | 640.2469567 | 0.7 |
| 200% A | 894.9641718 | 0.550131234 | 1626.819415 | 1.8 |
| 200% B | 731.5482832 | 0.730708661 | 1001.149051 | 1.6 |
| 300% A | 651.3328769 | 0.443744532 | 1467.810486 | 2.1 |
| 300% B | 670.3840228 | 0.515135608 | 1301.373876 | 1.1 |

By adjusting the angle of the track, PCL fibers were elongated from 0-350% immediately upon collection. Subsequent tensile testing to failure after complete drying resulted in elongations up to only 83%. In one embodiment, semi-solid post-drawing during manufacturing caused only a modest decrease in maximum elongation during tensile testing after complete drying. FTIR was performed on the PCL fibers to investigate the effect of post-drawing on the nanofiber chemical organization. Several systematic peak shifts were observed with increasing draw ratios from flat plate control to 0, 100, 200 and 350% elongation. These preliminary tests prove that electrospun nanofiber post-drawing is possible using the disclosed system and method in the present invention and indicate that the post-drawing can occur in the semi-solid state before complete solvent evaporation, i.e. "wet-stretching" is feasible. Characteristic PCL spectral peak shifts indicate macromolecular reorganization associated with post-drawing processing. These results justify further investigation into the mechanisms involved in post-drawing individual electrospun nanofibers in the semi-solid and solid state.

Figure 5:
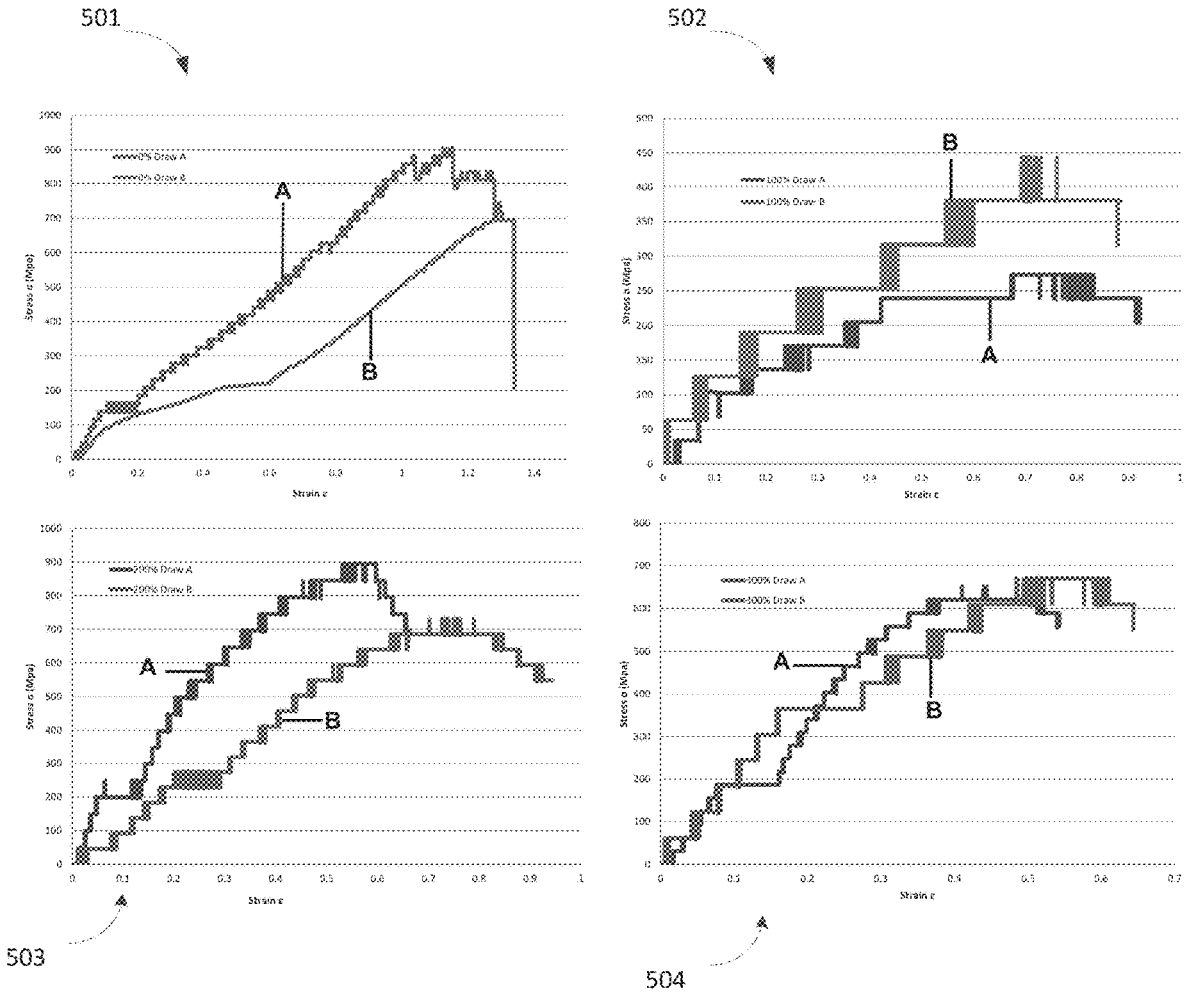
FIG. 5 illustrates stress-strain curves of fibers with various post-draw ratios using a manufacturing process according to one embodiment.
Figure 6:
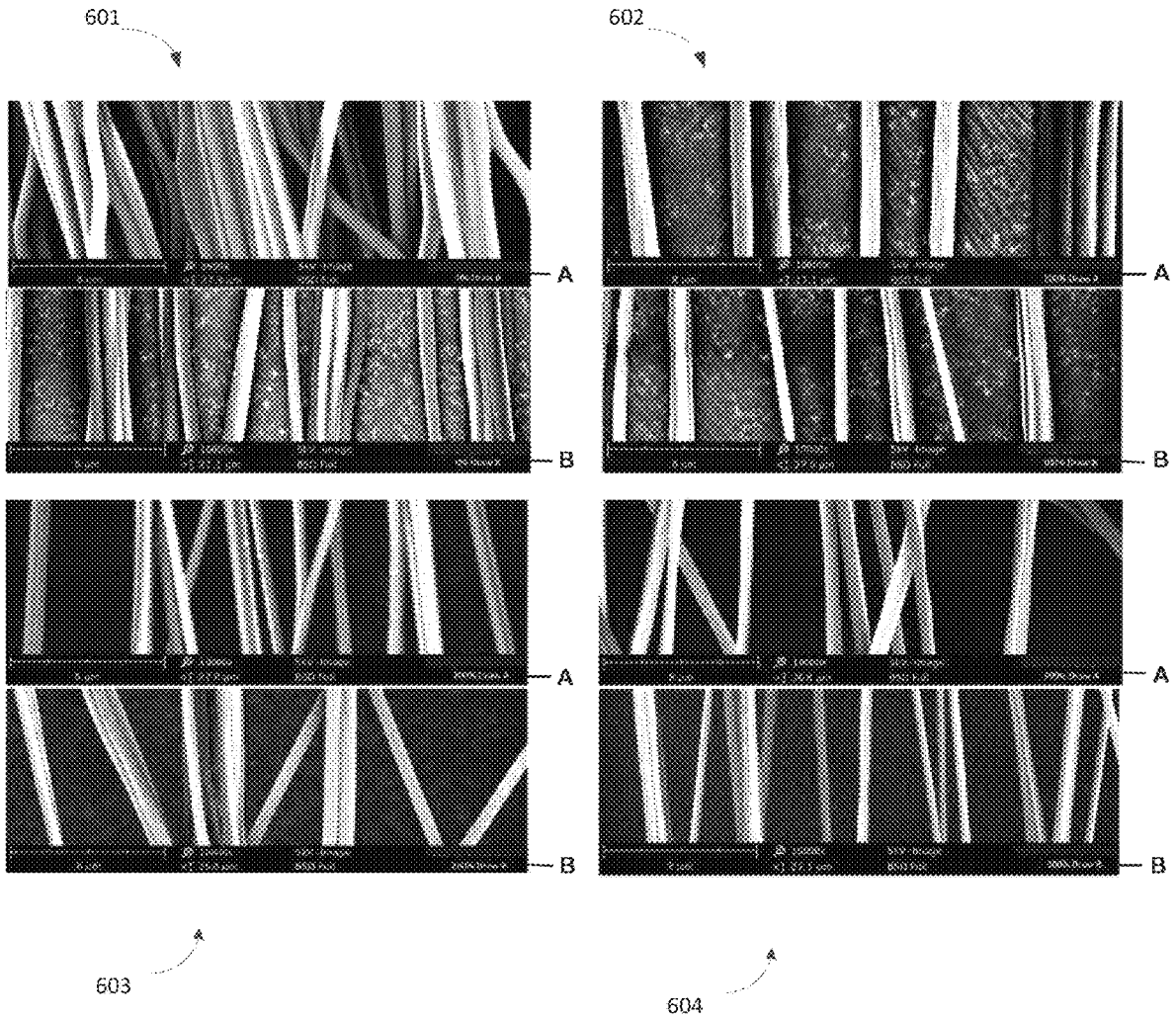
FIG. 6 illustrates SME images of fiber area and density of fibers with various post-drawing ratios using a manufacturing process according to one embodiment.

With reference to FIG. 5, stress-strain curves at 0%, 100%, 200% and 300% draw ratios are respectively shown at 501, 502, 503 and 504 (for both draw A and draw B, two replicate samples), for which the x-axis is strain and the y-axis is stress (Mpa). These preliminary stress-stain curves were plotted to show changing mechanical properties with increasing fiber elongation ratios. The SEM images of the fibers at 0%, 100%, 200% and 300% draw ratios are also respectively shown at 601, 602, 603 and 604 in FIG. 6 (for both draw A and draw B). The Young's Modulus and ultimate strength at differing draw ratios are found in Table 1 above.

Figure 7:
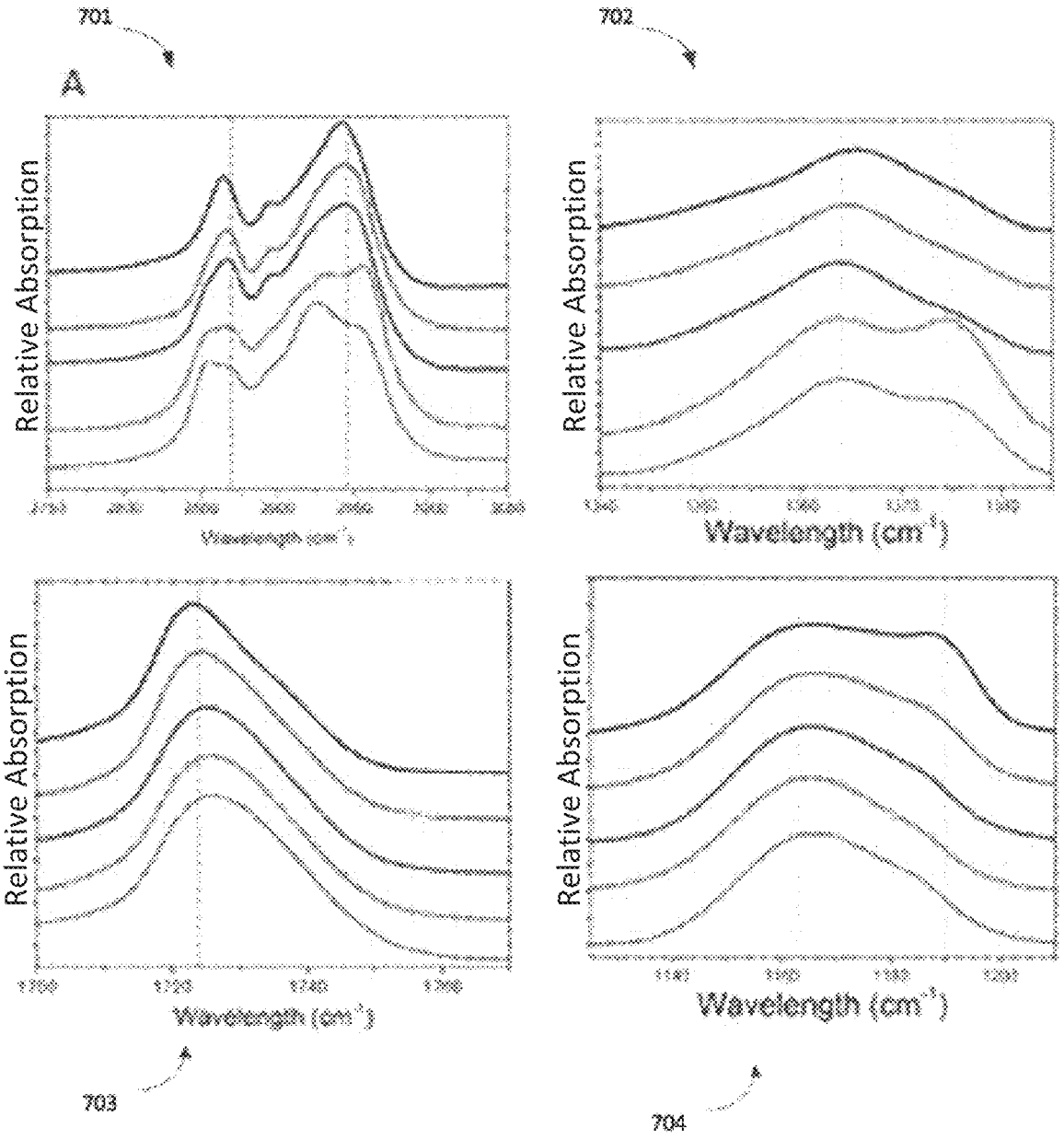
FIG. 7 illustrates systematic shifts in the FTIR spectra of fibers with various post-draw ratios using a manufacturing process according to one embodiment

With reference to FIG. 7, FTIR analysis 701, 702, 703 and 704 each shows changes in bond activities with different percent elongations for $CH_2$ bond stretching, $CH_2$ bond bending, carbonyl (C═O) and OC—O stretching, respectively. The top to bottom curves represent flat plate, 0%, 100%, 200% and 350% post-draw, respectively. Processing parameters and environmental conditions were recorded in Table 2 below to show the ideal condition for production when collecting each sample to determine effects on fiber properties. This result indicates that "wet-stretching" (i.e. post drawing individual nanofibers before residual solvent has completely evaporated) has an effect on the macromolecular properties of the fibers.

TABLE 2

| Peak | Bond Present | Bond Action |
|---|---|---|
| 2949 | $CH^2$ | Asymmetric Stretching |
| 2865 | $CH^2$ | Symmetric Stretching |
| 1727 | C═O | Stretching |
| 1190 | OC—O | Stretching |
| 1165 | COC | Symmetric Stretching |
| 1375 | $CH^2$ | Bending |
| 1362 | $CH^2$ | Bending |

Using the method and system disclosed in the present invention, nanofibers can be electrospun and post-drawn (or stretched) at variable draw ratios while they were still moldable, before full solvent evaporation. During fiber collection, environmental conditions were recorded to access effects of temperature and humidity. Tensile testing revealed changes in stress and strain between draw ratios. Young's modulus did increase with draw ratio although max draw did not induce max Ultimate Tensile Strength (UTS). This abnormality may be due to high humidity during collection of the sample. In another experiment with controlled humidity/temperature, the data reflects max UTS at max draw. FTIR peaks at different wavelengths indicate changes in bonds with different percent elongations. Draw Ratios, environmental conditions and associated fiber dimensions are shown in Table 3. It is therefore hypothesized that "wet-stretching" during fiber collection will enhance fiber macromolecular alignment and improve mechanical properties. In one preferred one embodiment, the configurations for 0% B, 100% B, 200% B and 300% B are used.

TABLE 3

| Sample | Initial L (mm) | Final L (mm) | Temp (° F.) | % Humidity | Avg. Fiber Diameter (nm) | Avg. Fiber Area (nm^2) | Fibers per samples |
|---|---|---|---|---|---|---|---|
| 0% A | 40 | 40 | 64 | 60 | 835.733 | 549000 | 7854 |
| 0% B | 40 | 40 | 66 | 61 | 803.067 | 507000 | 4902.8 |
| 100% A | 40 | 80 | 64 | 71 | 1002.000 | 789000 | 3712.8 |
| 100% B | 40 | 80 | 64 | 61 | 599.333 | 282000 | 5593 |
| 200% A | 40 | 120 | 66 | 60 | 603.933 | 286000 | 7021 |
| 200% B | 40 | 120 | 64 | 59 | 631.933 | 314000 | 6973.4 |
| 300% A | 40 | 160 | 66 | 81 | 790.533 | 491000 | 6568.8 |
| 300% B | 40 | 160 | 64 | 77 | 489.067 | 188000 | 8734.6 |

Similar processes of fabricating other materials that are described in Examples 1-4, Col. 12-16 of U.S. Pat. No. 7,828,539 to Beachley et al, which is incorporated here by reference, can also be used. In some embodiments, when some materials cannot be electrospun, a precursor will be used in conjunction with the system and method disclosed in the present invention. For example, carbon fibers cannot be directly spun from the electrospinning system, thus the method of fabricating can electrospin a precursor polymer such as polyacrylonitrile (PAN), which will become carbon fiber during heat treatment. In one embodiment, the diameters of precursor PAN may be in the range of submicron sale (e.g. 100-1000 nm), whereas the diameters of the carbon fibers produced by the fabrication system and process disclosed herein may be reduced by 50% at about 300% draw rate. In one embodiment, the heat treatment could occur while the fibers are still on the device (see FIG. 9) and it may be beneficial to continue to stretch the fibers during and after carbonization.

In some embodiments, the system may be configured to allow for systematic post-drawing with high draw rate, delay and/or under elevated temperature. For example, with reference to FIG. 8, the system may be configured for high draw rate, where at least a first portion of each of the two conductive collection surfaces 801 are at a distance and an angle and at least a second portion of two conductive collection surfaces 802 are at a distance and in parallel. This will allow high draw rate of nanofibers in solvent semi-solid drawing. In one embodiment, the two tracks (or two conductive collection surfaces) may require additional rollers than those disclosed in FIG. 3 such that the conductive collection surface of each track may be divided into two portions. Alternatively and/or additionally, each track may be driven by one or more higher torque motors to accommodate the complexity of the tracks. When a fiber is deposited in the deposition area 803, it is moved away due to the motion of the conductive collection surface while being elongated until it reached certain point in the collection compartment 804. At this point, the fiber will be moving away from the deposition area continuously with the automated track movement but maintaining at the same draw ratio while being evaporated.

Figure 8:
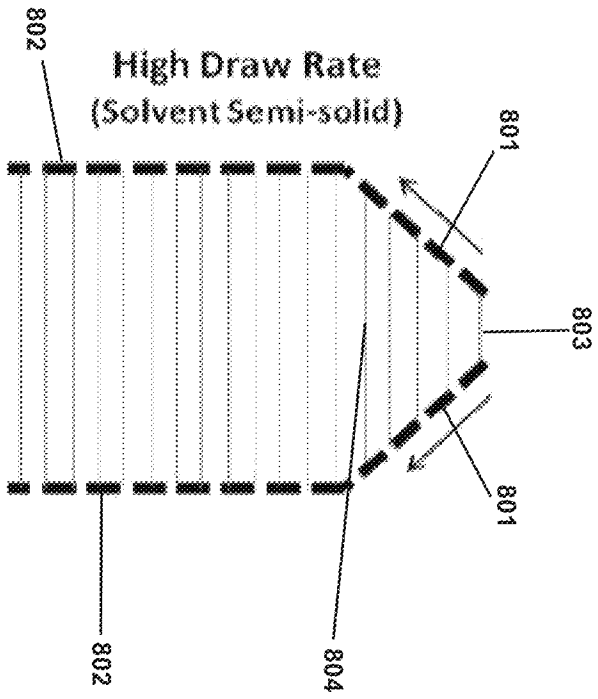
FIG. 8 illustrates a schematic design of high draw rate system according to one embodiment.
Figure 9:
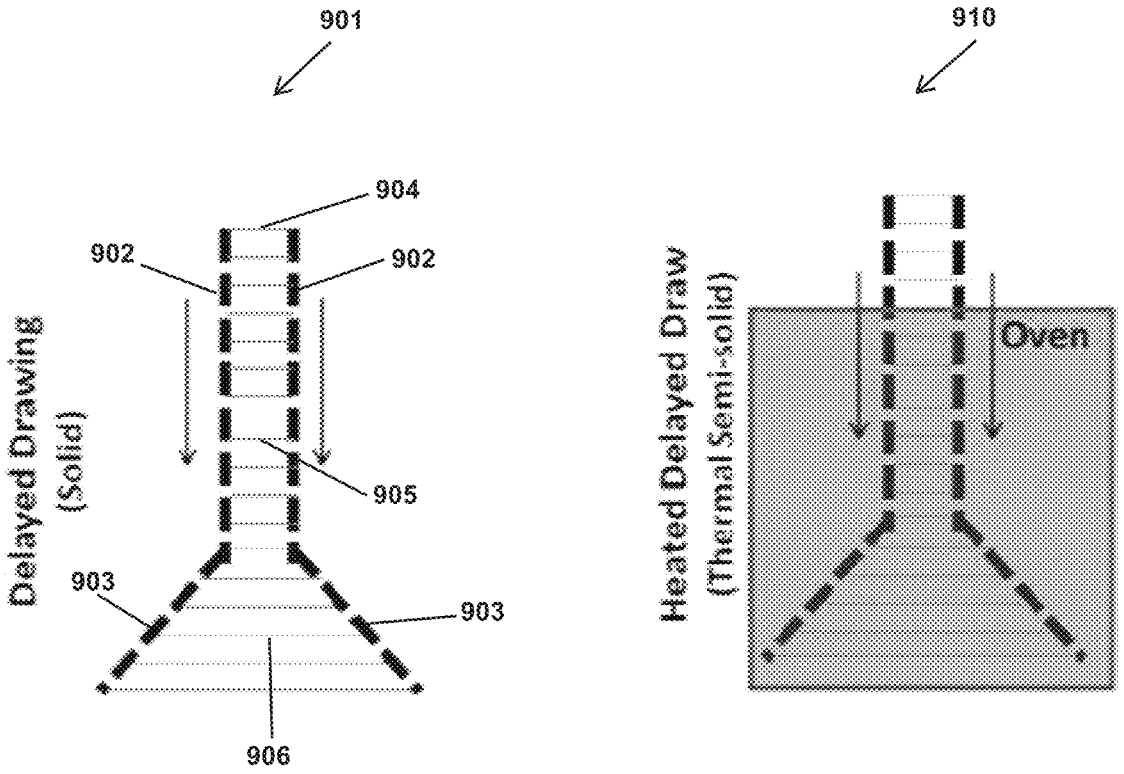
FIG. 9 illustrates schematic designs for delayed solid drawing and thermal semi-solid drawing according to various embodiments.

With reference to FIG. 9, a system for delayed drawing 901 may be configured similar to the embodiment in FIG. 8, but the order of the angled conductive collection surfaces and the parallel conductive collection surfaces is reversed. In other word, at least a first portion of each track 902 are at a distance and in parallel, and at least a second portion of each track 903 are at a distance and at an angle. The embodiment of FIG. 9 may allow delayed solid drawing, in which process the fiber that is deposited in the deposition area 904 is first moved away from the deposition area and into the collection compartment 905 with the moving conductive collection surface without being elongated. This allows the solvent to evaporate in the collection compartment before the fiber reaches a post-drawing area 906 that are defined by the second portions of each track. In the post-drawing area 906, the fiber will be elongated in a solid state while being drawn to the collection rack (not shown).

With further reference to FIG. 9, the embodiment of 901 may be installed in an oven to incorporate temperature control to the post-drawing process. This will allow for thermal semi-solid drawing. Similar to the embodiment in FIG. 8, the delayed drawing system 901 or heated delayed drawing system 910 may include one or more additional rollers and/or higher torque motors.

Figure 10:
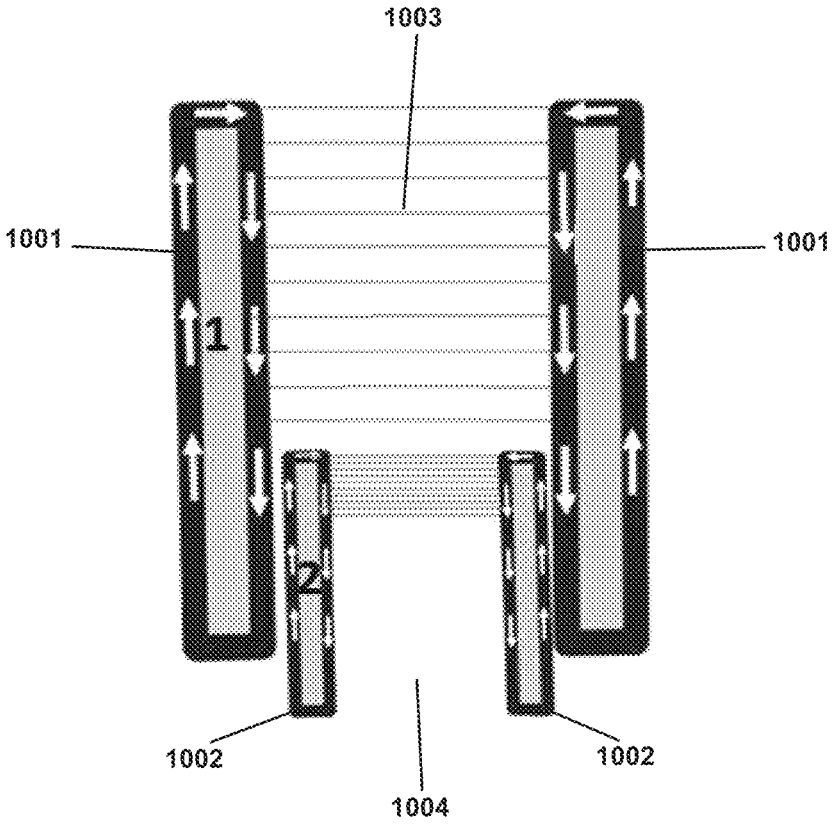
FIG. 10 illustrates schematic design of dual-track system according to various embodiments.

With reference to FIG. 10, alternatively and/or additionally, the collection system may also be configured to have dual track systems 1001 and 1002, each system having two tracks or two conductive collection surfaces. Such dual track system will allow for control of fiber density in 3D in the x-y and z planes. In one embodiment, each tracks system will move at the same or different speed. In one embodiment, the track system 1001 and 1002 are disposed with their collection compartments 1003 and 1004 aligned and the conductive collection surfaces of the two tracks being placed proximate to each other and configured to move in the same direction. This allows the fiber to contact both tracks during its path and shear off to transfer from track 1001 to track 1002, similar to the collection on a static rack in the one-track system. The embodiment disclosed in FIG. 10 would allow flexibility in terms of configuration of the tracks, the speed of each track so that the fiber could be stretched or relaxed or undergo other processes during the path of a second track as it is angled or otherwise induces manipulation. In one embodiment, the dual track systems may be configured in that one track system includes parallel tracks and the other track system has angled or orthogonal tracks, or vice versa.

The system and method for electrospun fiber straining and collecting in various embodiments disclosed in this document allow nanofiber fabrication to be integrated with processing and assembly within a continuous scalable nanomanufacturing platform, which can be used to fabricate high performance nanofibers from various materials under various conditions.

Figure 11:
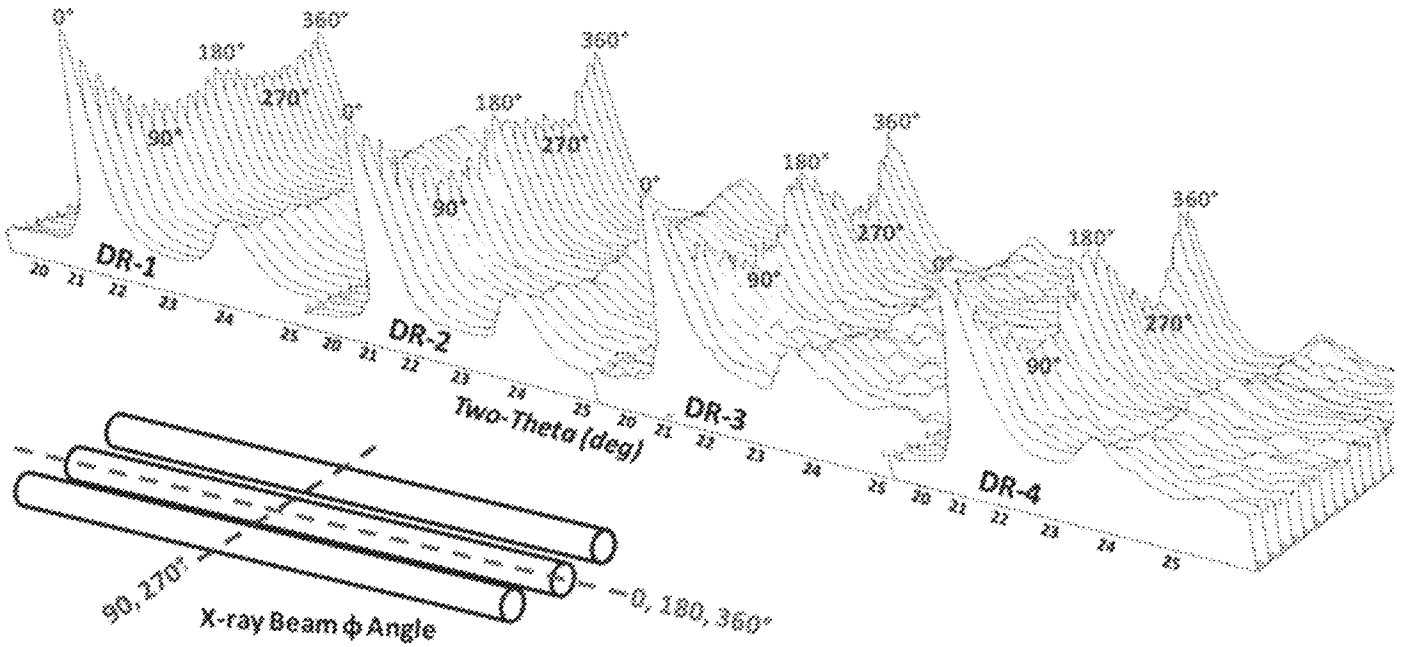
FIG. 11 illustrates macromolecular alignment along the fiber axis according to various embodiments.

In one embodiment, the nanofiber macromolecular properties, such as chain orientation, crystalline structure and/or crystal alignment, may further be ascertained as to the effect of post-drawing. For example, it is hypothesized that nanofibers are weaker than their microfiber counter parts because of chain relaxation and the lack of a post-drawing step. FIG. 11 depicts wide angle x-ray diffraction (WAXD) counts for 15 degree intervals around aligned PCL nanofiber samples in the plane of a thin multi-fiber array. Samples with draw ratio (DR) from 1 to 4 expereinced an intensity differential at the 21.7 degree peak depending on the angle of the x-ray beam relative to the direction of the fiber axis. Peak differential, which was highest parallel to the fiber axis and lowest perpendicular to the fiber axis, increased with increasing DR, indicating post-drawing induced macromolecular orientation.

In one embodiment, the configurations of the system may be adjusted to accommodate temperature and solvent evaporation requirements in fabricating different materials, so that advanced nanofiber materials with enhanced properties, such as mechanical, piezoelectric, electrical and/or thermal performance can be produced. Generally, materials such as, synthetic and natural polymer materials that are compatible with electrospinning and organic and inorganic materials resulting from processing of electrospun polymer nanofibers and electrospun polymer nanofiber composites containing other polymer and non-polymer materials, can be used.

By way of example, several materials have been verified to be compatible with electrospinning nanofiber fabrication in literatures, such as Zussman, E. et al, *Mechanical and structural characterization of electrospun PAN-derived carbon nanofibers*. Carbon, 2005. 43(10): p. 2175-2185. For example, polyvinylidene difluoride (PVDF) is a pure thermoplastic fluoropolymer with strong piezoelectrical activity; polyaniline (PANT) is a semi-flexible rod polymer with high electrical conductivity properties; silk is naturally derived biomaterial with exceptional thermal conductivity; polyacrylonitrile (PAN) is a semicrystalline polymer resin that is a chemical precursor to most conventional carbon fiber; and carbon fibers exhibit exceptional strength to weight ratio, electrical, and thermal properties. All of these materials are suitable to be electrospun and fabricated in the system disclosed in various embodiments of the present invention, whereas each has different molecular structure, different boiling points, requires different solvents and different functional testing based on the most interesting properties anticipated for each material. These properties and fabrication conditions are listed in FIG. 12.

In one embodiment, the present invention describes nanofibers that can be fabricated for any intended use including high-strength light-weight composites, filtration/absorption materials, sensors/electronic devices and smart materials, batteries/energy harvest, and biomedical devices etc. In at least one embodiment, post drawing of a plurality of nanofibers are designed and produced according to the process described herein. In one embodiment, the disclosed system and method of fabricating nanofibers may be used to optimize the performance of the above mentioned materials. For example, the piezoelectric voltage produced by PVDF fiber increases with increasing draw ratio.

In some embodiments, polymer nanofibers can be systematically post-drawn under different conditions in order to elucidate mechanisms involved in macromolecular re-arrangement. Under these various conditions, one or more parameters may have to be changed. For example, polymer fiber diameter can be decreased by decreasing polymer solution concentration. In one embodiment, PCL nanofibers with diameters from 250-1700 nm can be produced at solution concentrations from 4-20% respectively. The ultimate draw ability will be determined by increasing draw ratio up to 20× and draw rate up to 5× per second until uniform fibers arrays cannot be manufactured. These values will be used at upper limits for draw rate or total elongation. Nanofibers will be classified as solid or semi-solid. Semi-solid conditions will result from incomplete solvent evaporation or elevated temperatures. Sufficient solvent evaporation to classify "solid" fibers will be determined experimentally for each set of parameters by identifying the drying time at which maximum elongation is not decreased by further drying.

In one embodiment, polymer solution concentration and electrospinning parameters will be fixed or vary as required to obtain uniform nanofibers with desired fiber diameter. For example, fiber diameter, draw rate, drawing delay, and total elongation may be tested with the range: Upper limit (UL), 66% UL, 33% UL, and 0 or lower limit. PCL fibers may be post-drawn at temperatures of 50° C., 40° C. and 20° C. and PU and PLA may be drawn at 150° C., 100° C., 50° C., and 20° C. Maximum temperatures may approach the melting points of PCL and polyurethane (PU)/poly lactic acid (PLA) respectively.

In one embodiment, as shown in Table 4 below, for different conditions, some single variables important to post-drawing mechanics are identified.

TABLE 4

| Mechanism | Solution Concentration 4-35% | Solvent DCM, DMF, HFIP, formic acid | Electrospinning parameters voltage, rate, etc. | Fiber Diameter 250-1000 nm | Drawing rate 0-5×/sec. | Drawing Delay 0-10 min | Total Elongation 0-20× | Drawing Temperature 20-150° C. |
|---|---|---|---|---|---|---|---|---|
| Semisolid-to-solid transition (solvent) | — | — | — | — | — | Variable | — | — |
| | as required | Variable | as required | — | — | — | — | — |
| Post drawing kinetics | — | — | — | — | Variable | — | — | — |
| | — | — | — | — | — | — | Variable | — |
| Size effect: Molecular confinemtn (<300 nm) | as required | as required | as required | Variable | — | — | — | — |
| Semisolid-to-solid transition (thermal) | — | — | — | — | — | — | — | Variable |
| Solvent vs. thermal mediated ductibility | — | — | — | — | — | Variable | — | Variable |

In some embodiments, various conditions and parameters may influence various properties of the fibers. For example, fiber post-drawing in the nanoscale is expected have differences from micro or macroscale post-drawing. Mechanisms unique to the nanoscale include molecular confinement in nanofibers with diameters less than 300 nm and enhanced mass and thermal transport properties due to the high surface area to volume ratio of nanofibers. In one embodiment, the mechanisms of post-drawing in semi-solid (solution & temperature) and solid state electrospun nanofibers with regard to crystallinity, orientation of crystallites, and orientation of amorphous regions can be ascertained, especially the effects of confinement driven molecular orientation as nanofiber diameters fall below 300 nm. Several mechanisms of interest are described in detail below.

Solid drawing vs. semi-solid (solvent mediated) drawing: in one embodiment, the draw-ability of electrospun nanofibers is expected to decrease as solvent evaporates. For example, the semi-solid state of nanofibers may be systematically modified during post-drawing by varying the time delay (see FIG. 9), such as 1-10 min before drawing, the rate of drawing (0-5×/s), and the rate of evaporation (e.g. via solvent type, fiber diameter, and humidity).

Solid drawing vs. semi-solid (thermal mediated) drawing: in one embodiment, the draw-ability of electrospun nanofibers can also be increased with elevated temperatures. For example, the semi-solid state of nanofibers may be systematically modified during post-drawing by varying post-drawing temperature from 20° C. up to temperatures approaching the melting point of each polymer (see FIG. 9). Delay times up to 10 min will provide sufficient time for solvent evaporation before thermal mediated stretching.

Post drawing kinetics: in one embodiment, drawing rate and ratio are expected to influence nanofiber material properties. For example, draw ratio will be systematically adjusted by drawing polymer materials to their upper limit (UL), 66% UL, 33% UL, and 0. The drawing rate can be set constant for different draw ratios by modifying device parameters, such as changing the speed of the tracks (201, 202 in FIG. 2). Nanofibers will be drawn to 66% UL elongation at different rates to isolate the effects of drawing rate. Further, a slow (DMF, formic acid) and fast evaporating solution (hexafluoro-2-propanol or HFIP, DCM) can be tested for each polymer.

Thermal vs. solvent mediated semi-solid drawing: in some embodiments, both solvent and temperature may cause semi-solid nanofiber conditions, but under different mechanisms. For example, under the mechanism of core-shell kinetics, Solvent semi-solid nanofibers will become solid as solvent diffuses out from the inner core and escapes from the outer fiber surface. External heat acts on the outer surface of semi-solid-thermal nanofibers and must conduct into the inner core. Thus, solvent semi-solid fibers may be more pliable at the core while thermal semi-solid fibers may be more pliable at their surface. In one embodiment, thermal and solvent semi-solid nanofibers can be post drawn with identical initial diameter, draw rate, and draw ratio. Surface and cross-sectional morphology will be compared with SEM & transmission electron microscopy (TEM). Macromolecular organization and crystallinity is compared with FTIR, Raman spectroscopy, and X-ray diffraction results.

Molecular confinement (investigate effects at <300 nm): previous studies have demonstrated increases in electrospun nanofiber mechanical strength at diameters less than 500 nm or less than 300 nm, as reported in Pai, C.-L., M. C. Boyce, and G. C. Rutledge, *Mechanical properties of individual electrospun PA* 6(3)*T fibers and their variation with fiber diameter*. Polymer, 2011. 52(10): p. 2295-2301. This effect is proposed to be due to the orientation of amorphous regions mediated by molecular confinement. The disclosed system and method in the present invention may allow post-drawing outside of, within, and crossing 300 nm. For example, nanofibers with initial diameters of 800, 500, and 300 nm will be reduced to 400, 250, and 150 nm respectively when they are drawn to 300% elongation.

Despite expectations of increased performance, electrospun nanofibers do not always possess increased mechanical strength compared to larger fibers manufactured by other methods. In one embodiment, the manufacturing/processing method may include preventing macromolecular chain relaxation that has been implicated in reduced strength. This can be done by evaluating the mechanical properties of electrospun nanofibers by tensile testing arrays of aligned fibers and via nanoindentation of single fibers, which are described as below.

Figure 13:
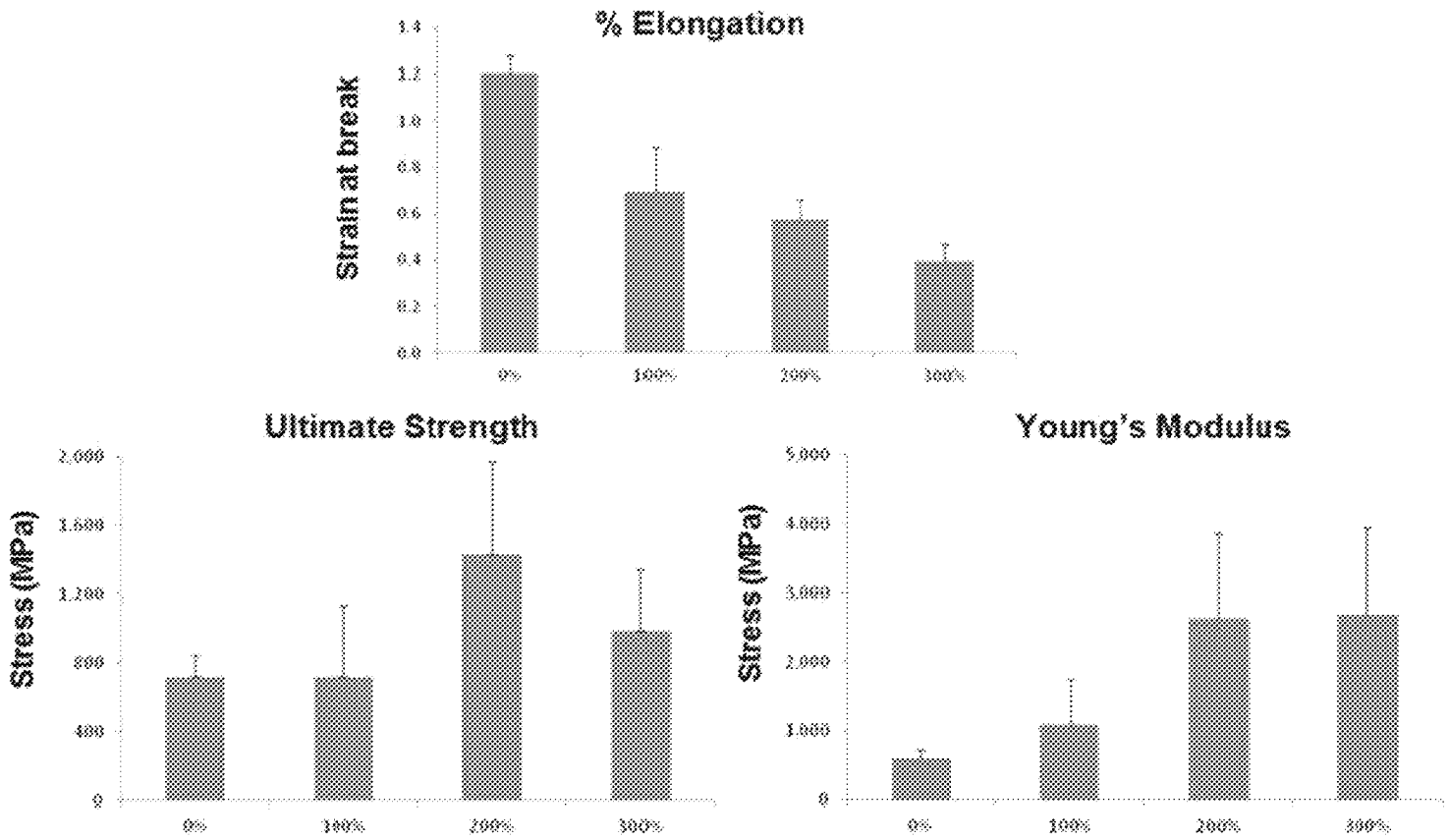
FIG. 13 illustrates effect of elongation ratio on various mechanical properties according to various embodiments.

Tensile testing (arrays): the mechanical properties of bulk fiber array materials, such as elastic (Young's) modulus, yield points, thermo-mechanical properties, stress-strain characterization, cross-linking density, and the swelling ratio can be tested. The cross-sectional areas of fiber bundles can be calculated using fiber diameter and fiber density information obtained from SEM images. The initial elastic modulus, yield stress, tensile strength, and elongation ratio of samples can be calculated from stress/strain plots. With reference to FIG. 13, the effect of elongation ratio on mechanical properties, such as elastic modulus and ultimate tensile strength, is shown.

Nanoindentor (single fiber): in one embodiment, similar to the conventional compression tests, measurements of elastic modulus and elasticity (resilience %) of different single nanfiber materials in the nano-scale can be conducted using variable nano-indentation methods (atomic force microscopy or AFM operated in force mode). Force-distance curves for each fiber can be measured multiple times in a very small region especially for the fibers-substrate contacting regions, and the calculated elastic parameters can be averaged with the standard deviation. Single nanofiber materials, which cannot be characterized by the usual mechanical tests, are well suitable for AFM force-distance curve measurements.

In one embodiment, the performance of piezoelectric nanofibers may be enhanced with the systems and fabrication methods disclosed in the present invention. Piezoelectric nanomaterials are an important research area with technological applications in energy harvest and micro/nanoactuation. Piezoelectric nanofibers have advantages of improved performance and size compatibility for micro/nano applications. In one embodiment, different nanofibers (e.g. PVDF) can be produced and evaluated of their functional performance based on their voltage generation in response to mechanical deformations. Alternatively, a Piezoresponse Force Microscopy (PFM) based on our AFM instrument can also be used to measure the piezo-activity of nanofiber materials in the nanoscale. In order to excite deformation of samples with piezoelectric effect, an alternating current bias will be applied to the tip of a sharp AFM conductive probe, and the tip will scan the nanofiber material surface in contact mode. The resulting deflection of the probe cantilever can be detected by a standard split-diode photodetector method. In this way, topographical imaging and piezoresponse of nanofiber materials can be characterized simultaneously with high resolution. In one embodiment, by comparing the wet stretched nanofibers to existing piezoelectric materials and investigating the relationship between performance, macromolecular composition, and manufacturing parameters, increased piezoelectric voltage output for PVDF nanofibers with increasing draw ratio is observed using the disclosed systems and methods in the present invention can be ascertained.

Electrically conductive nanofibers are highly desirable materials for micro/nano electronics applications, and electrical properties of conductive nanofibers materials can be sensitive to their macromolecular structure. In some embodiments, the relationship between polyaniline and carbon nanofiber material properties and electrical properties under different nanofiber post-drawing conditions in the systems and processes disclosed in the present invention can be ascertained. For example, electrical conductivity can be measured using a Two Quantum Design Physical Properties Measurement System (PPMS), an advanced instrument currently located in the Rowan Physics Department Material Laboratory. The PPMS is a high-standard system for multiple physical property measurements that can operated at up to 9 Tesla, with a low temperature scan range of 2K to 400 K (and with a 1000 K oven), for measurements of AC susceptibility, DC magnetization, ac/dc resistivity with rotator, Hall effect etc., and has a liquid $He_3$ attachment for heat capacity and resistivity measurement with a sensitivity of 350 mK. In one embodiment, the maximum performance of post-drawn nanofibers is compared to undrawn nanofibers and conventional fibers manufactured by other methods.

Polymer nanofibers with high thermal conductivity or thermal insulating stability are desirable in applications in thermal management and energy storage. Thermal conductivity can be significantly dependent on macromolecular organization. In one embodiment, the thermal conductivity of nanofibers can be assessed, such as measuring different thermal transport properties simultaneously, including (a) thermal conductivity, (b) Seebeck coefficient, (c) electrical resistivity, and/or the (d) thermoelectric figure of merit using the PPMS system. In one embodiment, the relationship between thermal conductivity and nanofiber materials properties and manufacturing parameters is ascertained, and the performance of polymer nanofibers is compared with maximum performance to fibers manufactured by other methods.

Polyacrylonitrile fibers (PAN) are generally converted to carbon fibers with three mechanical/thermal processes named stabilization, carbonization, and graphitization, as described in Rahaman, M et al, *A review of heat treatment on polyacrylonitrile fiber*. Polymer Degradation and Stability, 2007. 92(8): p. 1421-1432. In some embodiments, stabilization may use the systems and methods disclosed in the present invention, which may involve simultaneous stretching/drawing and heating at 200-300° C. that would result in a congregated ladder structure. Alternatively and/or additionally, carbonization may be performed at ~1000° C. and final carbon fiber strength can be enhanced by stretching/drawing during carbonization. The present invention is uniquely capable of stretching individual electrospun nanofibers and this can be performed within a versatile continuous manufacturing platform. Final carbon fiber density can be changed due to structure compaction during the early processing stages to be performed on PAN precursor fibers. In one embodiment, when carbon nanofibers are produced from PAN fibers under various post-drawing conditions including solvent and thermal semi-solid stretching, the performance of the embodiments in the present invention can further be ascertained by measuring the final density of carbon nanofibers. The measuring of density of carbon nanofibers can use known technique such as flotation technique as disclosed in Ozbek, S. et al, *Strain-induced density changes in PAN-based carbon fibres*. Carbon, 2000. 38(14): p. 2007-2016.

In some embodiments, PCL nanofibers with diameters from 250-1000 nm can be electrospun and fed to a rotating yarn leader using the present invention. In one embodiment, nanofibers with packing densities from 10-100% can be fed to the rotating yarn leader. Leader rotation and translation rates can be optimized to form tightly wound yarns with target diameters from 10-100 μm and twist angles from 10-70°. The range of each parameter can be adjusted if the forces generated cause nanofiber breakage. In one embodiment, the effect of coefficient of friction on yarn mechanical properties may be ascertained by spinning yarns from blended PCL and poly(ethylene glycol) (PEG) nanofibers. Blended fibers can be electrospun from PCL solutions with PEG added at 0-30% weight in the common solvent HFIP. Manufactured yarns can be evaluated with SEM to characterize overall yarn diameter, fiber count, nominal twist, variation of twist and irregularities. The mechanical properties of yarns can be evaluated for tensile strength and elongation at maximum force using a universal testing machine. In one embodiment, the present invention may also be integrated with a staple yarn spinning such that electrospinning, post-drawing, and staple yarn spinning are seamlessly integrated. This may require combining multiple devices and matching the rates of fiber collection and yarn feed by modifying device parameters. Multiple electrospinning jets can be used if the electrospinning rate is much lower than the required yarn feed rate.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

What is claimed is:

1. A system for forming an electrospun nanofiber array, comprising:

a first conductive collection surface further comprising a first proximate end and a first distal end;

a second conductive collection surface positioned facing the first conductive collection surface, further comprising a second proximate end and a second distal end, wherein:

the first proximate end and the second proximate end define a proximate gap between the first proximate end and the second proximate end;

the first distal end and the second distal end define a distal gap between the first distal end and the second distal end;

the first proximate end and the second proximate end further define a deposition area positioned within the proximate gap;

a first portion of the first conductive collection surface and a first portion of the second conductive collection surface are further positioned to define a track angle θ, wherein the length of the distal gap is different than the length of the proximate gap.

2. The system according to claim 1, wherein at least one applies:

(a) the first portion of the first conductive collection surface and the first portion of the second conductive collection surface are aligned to each other and form two opposing sides of an isosceles trapezoid;

(b) a second portion of the first conductive collection surface and a second portion of the second conductive collection surface are parallel to each other.

3. The system according to claim 1, wherein the electrospinning nozzle has an axis perpendicular to a length of the electrospun fiber.

4. The system according to claim 1, further comprising:

a collection compartment configured to receive the transported electrospun fiber, wherein the collection compartment defines a plane that is parallel or normal to the axis of the electrospinning nozzle.

5. The system according to claim 1, wherein the first conductive collection surface and the second conductive collection surface are endless travelling belts.

6. The system according to claim 1, wherein at least one applies:

(a) a first portion of the first conductive collection surface and a first portion of the second conductive collection define an area in between that includes the deposition area;

(b) the second portion of the first conductive collection surface and the second portion of the second conductive collection define an area in between that includes the deposition area.

7. The system according to claim 1, further comprising a collection rack disposed inside a collection compartment for removing a fiber from the first conductive collection surface.

8. The system according to claim 1, further comprising a first roller configured to adjust elongation of the first portion of the first conductive collection surface and a second roller configured to adjust elongation of the first portion of the second conductive collection surface.

9. A method of forming an array of nanofibers, comprising:

electrospinning a fiber from an electrospinning nozzle;

attaching, in a deposition area, a first end of the electrospun fiber to a first conductive collection surface and a second end of the electrospun fiber to a second conductive collection surface, wherein:

the first conductive collection surface further comprises a first proximate end and a first distal end and the second conductive collection surface is positioned facing the first conductive collection surface, the second conductive surface further comprises a second proximate end and a second distal end;

the first proximate end and the second proximate end define a proximate gap between the first proximate end and the second proximate end;

the first distal end and the second distal end define a distal gap between the first distal end and the second distal end;

the first proximate end and the second proximate end further define the deposition area positioned within the proximate gap; and a first portion of the first conductive collection surface and a first portion of the second conductive collection surface are further positioned to define a track angle θ;

transporting the electrospun fiber distally away from the deposition area; and modifying, during the transport, a length of the electrospun fiber based at least in part on a difference between the length of the proximate gap and the length of the distal gap.

10. The method according to claim 9, wherein the electrospinning nozzle has an axis perpendicular to the length of the fiber.

11. The method according to claim 9, wherein at least one applies:

(a) the first portion of the first conductive collection surface and the first portion of the second conductive collection surface are aligned to each other and forming two opposing sides of an isosceles trapezoid;

(b) a second portion of the first conductive collection surface and a second portion of the second conductive collection surface are parallel to each other.

12. The method according to claim 9, further comprising removing the electrospun fiber from the first and second collection surfaces to a collection rack disposed inside a collection compartment.

13. The method according to claim 9, further comprising adjusting a geometry of the first portion of the first conductive collection surface via a first roller and a geometry of the first portion of the second conductive collection surface via a second roller.

* * * * *